US009375376B2

(12) United States Patent
Latney

(10) Patent No.: US 9,375,376 B2
(45) Date of Patent: Jun. 28, 2016

(54) WHEELCHAIR BED INSERT DEVICE

(71) Applicant: Ray Latney, Bowie, MD (US)

(72) Inventor: Ray Latney, Bowie, MD (US)

( * ) Notice: Subject to any disclaimer, the term of this patent is extended or adjusted under 35 U.S.C. 154(b) by 0 days.

(21) Appl. No.: 14/534,771

(22) Filed: Nov. 6, 2014

(65) Prior Publication Data

US 2016/0128885 A1 May 12, 2016

(51) Int. Cl.

| | |
|---|---|
| ***A47B 7/00*** | (2006.01) |
| ***A61G 7/16*** | (2006.01) |
| ***A61G 7/053*** | (2006.01) |
| ***A61G 5/00*** | (2006.01) |
| ***A61G 5/10*** | (2006.01) |
| *A61G 5/12* | (2006.01) |

(52) U.S. Cl.

CPC *A61G 7/16* (2013.01); *A61G 5/006* (2013.01); *A61G 5/1059* (2013.01); *A61G 5/1067* (2013.01); *A61G 7/053* (2013.01); *A61G 5/12* (2013.01); *A61G 2005/125* (2013.01); *A61G 2005/127* (2013.01); *A61G 2005/128* (2013.01); *A61G 2007/165* (2013.01)

(58) Field of Classification Search

CPC ... A61G 7/16; A61G 7/053; A61G 2007/165; A61G 5/1056; A61G 5/006; A61G 5/1059; A61G 5/1067; A61G 2005/125; A61G 2005/128; A61G 2005/165

See application file for complete search history.

(56) References Cited

U.S. PATENT DOCUMENTS 3,138,805 A * 6/1964 Piazza ..... A61G 5/00 297/411.34
4,240,169 A * 12/1980 Roos ..... A61G 3/06 297/DIG. 4
4,987,620 A * 1/1991 Sharon ..... A61G 5/006 5/600
5,134,737 A * 8/1992 Wyman ..... A61G 5/00 5/185
5,555,582 A * 9/1996 Jerideau ..... A61G 5/006 5/600
6,272,702 B1 * 8/2001 Uchida ..... A61G 5/006 5/600
8,157,287 B1 * 4/2012 Cleveland ..... A61G 5/006 280/30
2008/0133089 A1 * 6/2008 Bayomy ..... A61G 5/1059 701/49
2012/0073054 A1 * 3/2012 O'Keefe ..... A61G 7/018 5/618
2012/0153687 A1 * 6/2012 Kume ..... A61G 5/1067 297/118
2013/0074256 A1 * 3/2013 Tsukada ..... A61G 7/16 5/81.1 R

FOREIGN PATENT DOCUMENTS

EP 2583651 6/2011

* cited by examiner

*Primary Examiner* — David E Sosnowski
*Assistant Examiner* — Morgan McClure

(57) ABSTRACT

A wheelchair bed insert device facilitates transfer of a person from a bed to a wheelchair. The device includes a bed frame having an open space extending into a lateral side of the bed frame. A mattress has a slot therein aligning with the open space of the bed frame when the mattress is positioned on the bed frame. A chair frame is positionable in the open space. A chair pad is coupled to the chair frame occupying the slot in the mattress when the chair frame is positioned in the open space of the bed frame. Chair wheels are coupled to the chair frame wherein the wheels facilitate transport of a person seated on the chair pad.

13 Claims, 5 Drawing Sheets

WHEELCHAIR BED INSERT DEVICE

BACKGROUND OF THE DISCLOSURE

Field of the Disclosure

The disclosure relates to bed insert devices and more particularly pertains to a new bed insert device for facilitating transfer of a person from a bed to a wheelchair.

SUMMARY OF THE DISCLOSURE

An embodiment of the disclosure meets the needs presented above by generally comprising a bed frame having an open space extending into a lateral side of the bed frame. A mattress has a slot therein aligning with the open space of the bed frame when the mattress is positioned on the bed frame. A chair frame is positionable in the open space. A chair pad is coupled to the chair frame occupying the slot in the mattress when the chair frame is positioned in the open space of the bed frame. Chair wheels are coupled to the chair frame wherein the wheels facilitate transport of a person seated on the chair pad.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
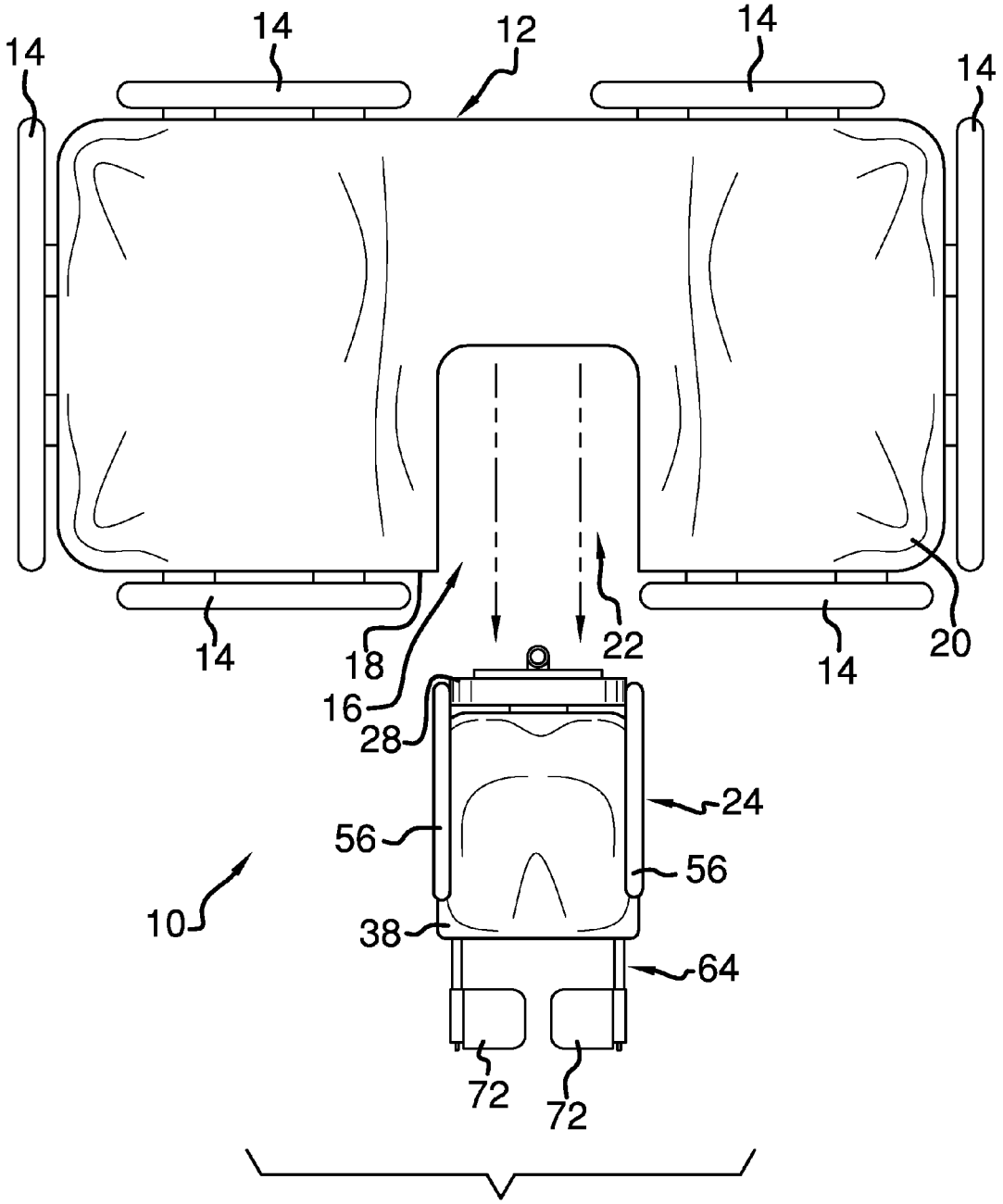
FIG. 1 is a top view of a wheelchair bed insert device according to an embodiment of the disclosure.
Figure 2:
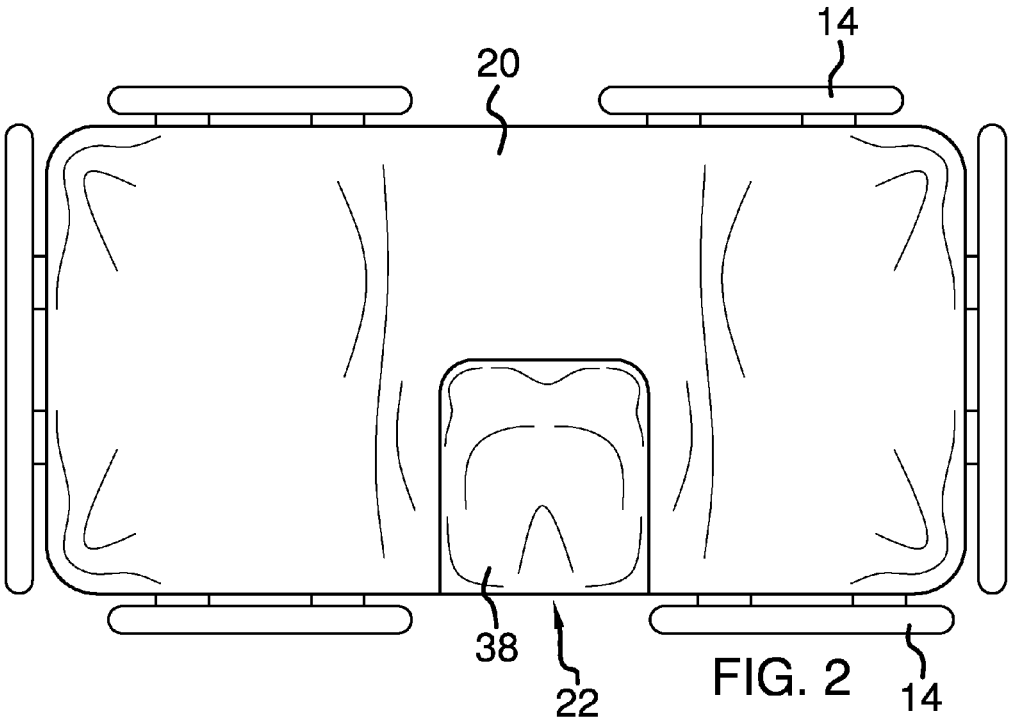
FIG. 2 is a top view of an embodiment of the disclosure in an attached position.
Figure 3:
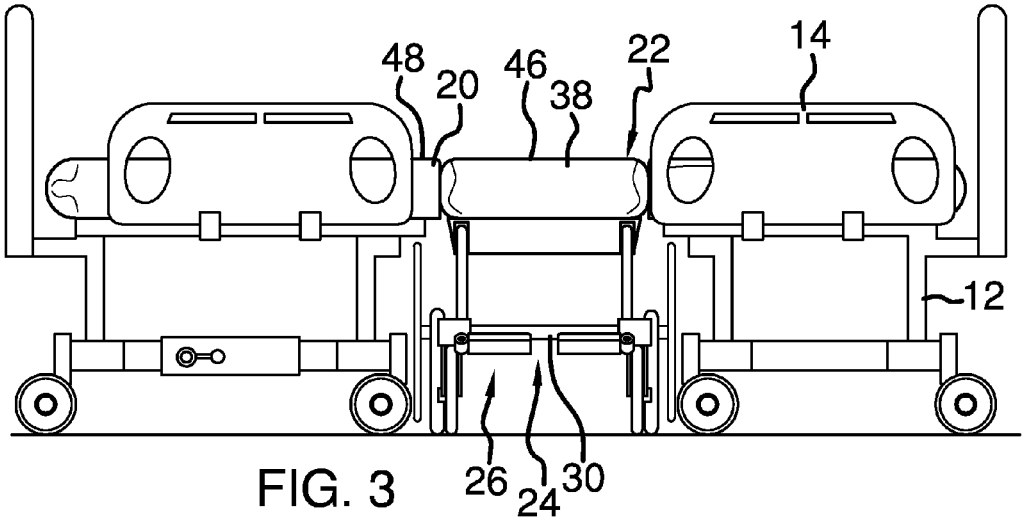
FIG. 3 is a front view of an embodiment of the disclosure.
Figure 4:
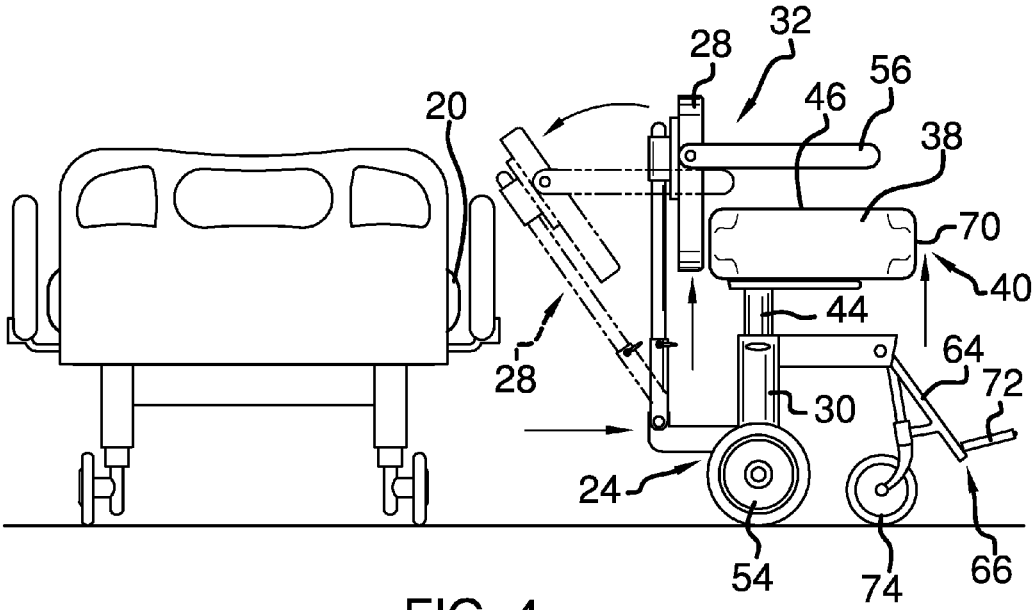
FIG. 4 is a side view of an embodiment of the disclosure in the detached position.
Figure 5:
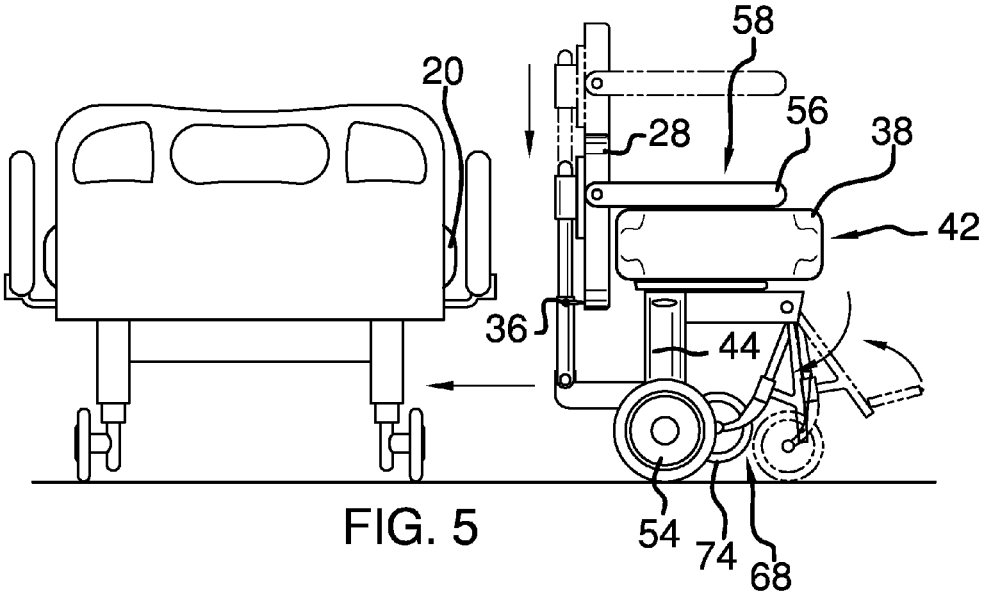
FIG. 5 is a side view of an embodiment of the disclosure in a detached position.
Figure 6:
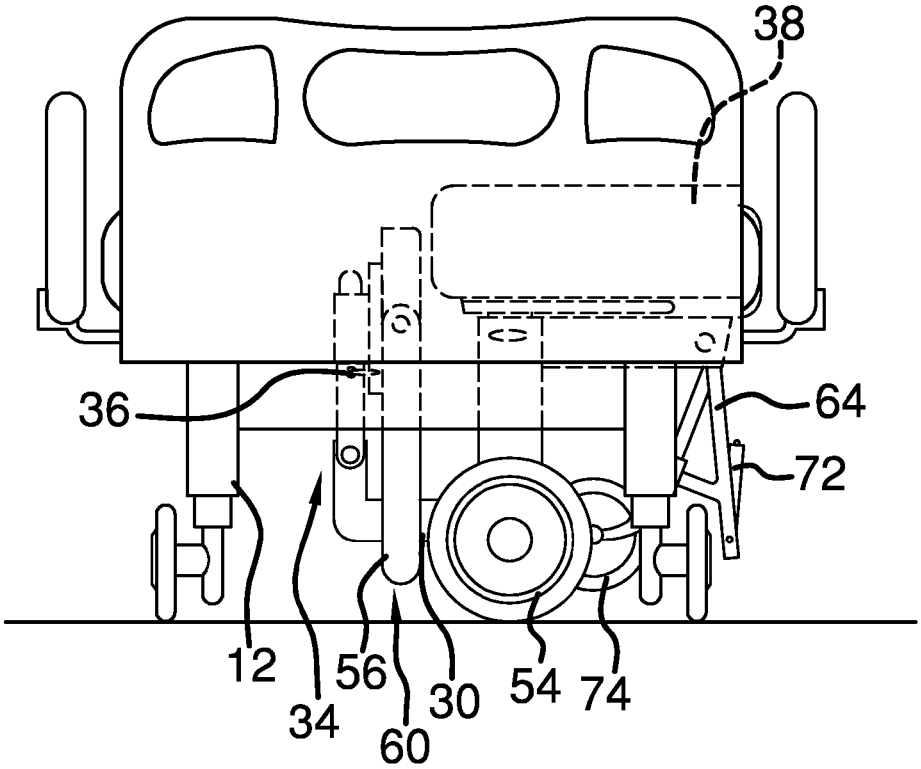
FIG. 6 is a side view of an embodiment of the disclosure in the attached position.
Figure 7:
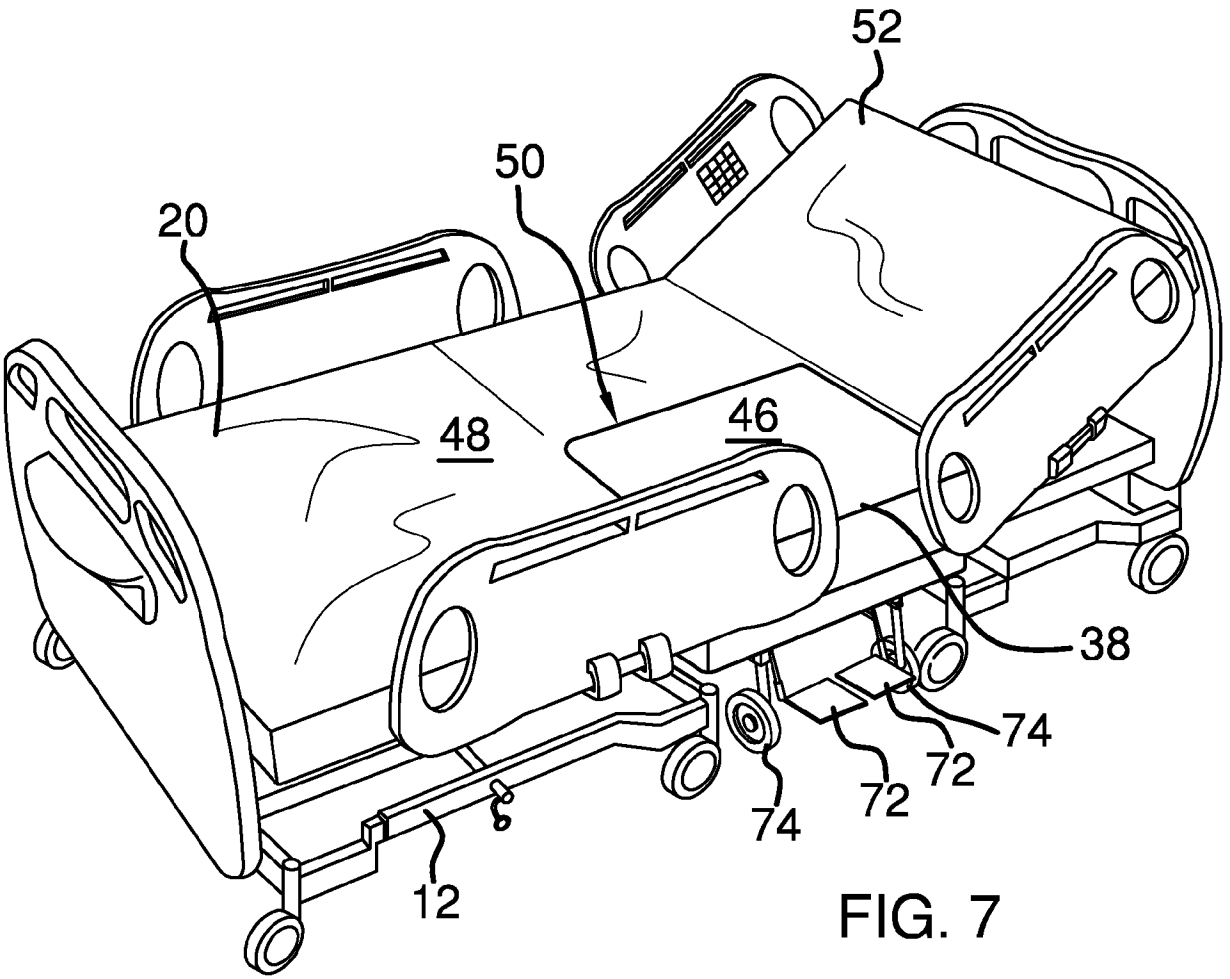
FIG. 7 is a top front side perspective view of an embodiment of the disclosure in the attached position.

With reference now to the drawings, and in particular to FIGS. 1 through 7 thereof, a new bed insert device embodying the principles and concepts of an embodiment of the disclosure and generally designated by the reference numeral 10 will be described.

As best illustrated in FIGS. 1 through 7, the wheelchair bed insert device 10 generally comprises a bed frame 12 generally of the type found in hospitals, convalescent homes, hospice, and the like. The bed frame 12 may include removable bed rails 14 and be wheeled in a conventional manner. The bed frame 12 has an open space 16 extending into a lateral side 18 of the bed frame 12. A mattress 20 has a slot 22 therein. The slot 22 aligns with the open space 16 of the bed frame 12 when the mattress 20 is positioned on the bed frame 12. A chair frame 24 is positionable in the open space 16 generally and may additionally extend into unused space under the bed frame 12 such that the chair frame 24 does not extend outwardly relative to a periphery of the bed frame 12. The chair frame 24 comprises a back section 28 and a main section 30. The back section 28 is adjustable between an upright position 32 and a stowed position 34.

A chair pad 38 is coupled to the chair frame 24. The chair pad 38 occupies the slot 22 in the mattress 20 when the chair frame 24 is positioned in the open space 16 of the bed frame 12. The chair pad 38 is telescopically coupled relative to the chair frame 24 wherein the chair pad 36 is adjustable between a raised position 40 and a dropped position 42. The chair pad 38 may be telescoped relative to the chair frame 24 by a pneumatic lift 44 to facilitate raising the chair pad 38 while a person is seated on the chair pad 38. An upper surface 46 of the chair pad 38 is coplanar with an upper surface 48 of the mattress 20 when the chair pad 38 is in the raised position 40. A shape of the chair pad 38 corresponds to a shape of the slot 22 wherein the chair pad 38 and the mattress 20 form a unified support surface 50 configured to support a person in a prone position. A head section 52 of the mattress 20 may be pivoted to raise the head of the person lying upon the support surface 50. The slot 22 is positioned adjacent to the head section 52.

The back section 28 is positioned laterally beneath the chair pad 38 in the stowed position 34 wherein the back section 28 is positionable under the bed frame 12 and mattress 20 preventing interference with positioning of the chair pad 38 occupying the slot 22. The back section 28 is telescopically coupled to the main section 30 of the chair frame 24 in a conventional manner wherein a height of the back section 28 relative to the chair pad 38 is adjustable. The back section 28 is also pivotally coupled to the main section 30 of the chair frame 24 in a conventional manner, such as by a hinge, wherein the back section 28 is pivotable away from the chair pad 38 for positioning the back section 28 in the stowed position 34. A locking mechanism 36 of conventional design such as a pin, hook, biased arm, or the like, is coupled to the chair frame 24. The locking mechanism 36 secures the back section 28 in the upright position 32. The back section is positioned to extend upwardly relative to the upper surface 46 of the chair pad 38 when the back section 28 is in the upright position 32.

The chair frame comprises a pair of arm rests 56. Each arm rest is adjustable between an extended position 58 and a retracted position 60. Each arm rest 56 is positioned in alignment with the back section 28 in the retracted position 60 wherein each arm rest 56 is prevented from interfering with positioning of the chair pad 38 occupying the slot 22. Each arm rest 56 is pivotally coupled to a respective side 62 of the back section 28 to extend forwardly from the back section 28 and above the upper surface 46 of the chair pad 38 when the arm rest 56 is in the extended position 58.

Each of a plurality of chair wheels 54 is coupled to the chair frame 24 wherein the chair wheels 54 facilitate transport of a person seated on the chair pad 38. A foot rest assembly 64 is pivotably coupled to the chair frame 24. The foot rest assembly 64 is pivotable between a use position 66 and a storage position 68. The foot rest assembly 64 extends outwardly relative to a perimeter edge 70 of the chair pad 38 when in the use position 66. The foot rest assembly 64 includes a pair of foot supports 72. Each of the foot supports 72 is spaced below the chair pad 38 wherein the foot supports 72 are configured for supporting feet of a person seated on the chair pad 38. The foot rest assembly 64 further comprises a pair of rest wheels 74. The rest wheels 74 extend lower than the foot supports 72 such that the rest wheels 74 are configured to support the foot supports 72 over a ground surface 76 when the foot rest assembly 64 is in the use position 66.

In use, the chair pad 38 is elevated and positioned in the slot 22 to form the unified support surface 50 mimicking a full sized conventional mattress. When it is desired to move a person resting on the unified support surface 50, the foot rest assembly 64 is extended and the person is positioned to sit up on the chair pad 38. The chair pad 38 may be lowered and the chair frame 24 moved away from the bed frame 12. The back section 28 may be moved into the upright position 32 and the arm rests extended to define a wheelchair for moving the person about. The process may be reversed to return the person to the prone position on the unified support surface 50 when needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheelchair bed insert device comprising:

a bed frame having an open space extending into a lateral side of said bed frame;

a mattress having a slot therein, said slot aligning with said open space of said bed frame when said mattress is positioned on said bed frame;

a chair frame positionable in said open space, said chair frame comprising a back section, said back section being pivotally adjustable between an upright position and a stowed position;

a chair pad coupled to said chair frame, said chair pad occupying said slot in said mattress when said chair frame is positioned in said open space of said bed frame, said chair pad being telescopically coupled relative to said chair frame wherein said chair pad is adjustable between a raised position and a dropped position, an upper surface of said chair pad being coplanar with an upper surface of said mattress when said chair pad is in said raised position, said back section being positioned laterally beneath said chair pad in said stowed position wherein said back section is positionable under said bed frame and prevented from interfering with positioning of said chair pad occupying said slot; and a plurality of chair wheels, each of said chair wheels being coupled to said chair frame wherein said wheels facilitate transport of a person seated on said chair pad.

2. The device of claim 1, further comprising said back section being telescopically coupled to a main section of said chair frame wherein a height of said back section relative to said chair pad is adjustable.

3. The device of claim 2, further comprising said back section being pivotally coupled to said main section of said chair frame wherein said back section is pivotable away from said chair pad for positioning said back section in said stowed position.

4. The device of claim 3, further comprising a locking mechanism coupled to said chair frame, said locking mechanism securing said back section in said upright position.

5. The device of claim 1, further comprising said back section being positioned to extend upwardly relative to an upper surface of said chair pad when said back section is in said upright position.

6. The device of claim 1, further comprising said chair frame comprising a pair of arm rests, each said arm rest being adjustable between an extended position and a retracted position, each said arm rest being positioned in alignment with said back section in said retracted position wherein each said arm rest is prevented from interfering with positioning of said chair pad occupying said slot.

7. The device of claim 6, further comprising each said arm rest being pivotally coupled to said back section extend forwardly from said back section and above an upper surface of said chair pad when said arm rest is in said extended position.

8. The device of claim 1, further comprising said chair pad being telescoped relative to said chair frame by a pneumatic lift.

9. The device of claim 1, further comprising a foot rest assembly pivotably coupled to said chair frame, said foot rest assembly being pivotable between a use position and a storage position, said foot rest assembly extending outwardly relative to a perimeter edge of said chair pad when in said use position.

10. The device of claim 9, further comprising said foot rest assembly including a pair of foot supports, each of said foot supports being spaced below said chair pad wherein said foot supports are configured for supporting feet of a person seated on said chair pad.

11. The device of claim 9, further comprising said foot rest assembly comprising a pair of rest wheels, said rest wheels extending lower than said foot supports such that said rest wheels are configured to support said foot supports over a ground surface when said foot rest assembly is in said use position.

12. The device of claim 1, further comprising a shape of said chair pad corresponding to a shape of said slot wherein said chair pad and said mattress form a unified support surface configured to support a person in a prone position.

13. A wheelchair bed insert device comprising:

a bed frame having an open space extending into a lateral side of said bed frame;

a mattress having a slot therein, said slot aligning with said open space of said bed frame when said mattress is positioned on said bed frame;

a chair frame positionable in said open space, said chair frame comprising a back section, said back section being pivotally adjustable between an upright position and a stowed position;

a locking mechanism coupled to said chair frame, said locking mechanism securing said back section in said upright position;

a chair pad coupled to said chair frame, said chair pad occupying said slot in said mattress when said chair frame is positioned in said open space of said bed frame, said chair pad being telescopically coupled relative to said chair frame wherein said chair pad is adjustable between a raised position and a dropped position, said chair pad being telescoped relative to said chair frame by a pneumatic lift, an upper surface of said chair pad being coplanar with an upper surface of said mattress when said chair pad is in said raised position, a shape of said chair pad corresponding to a shape of aid slot wherein said chair pad and said mattress form a unified support surface configured to support a person in a prone position, said back section being positioned laterally beneath said chair pad in said stowed position wherein said back section is positionable under said bed frame and prevented from interfering with positioning of said chair pad occupying said slot, said back section being telescopically coupled to a main section of said chair frame wherein a height of said back section relative to said chair pad is adjustable, said back section being pivotally coupled to said main section of said chair frame wherein said back section is pivotable away from said chair pad for positioning said back section in said stowed position, said back section being positioned to extend upwardly relative to an upper surface of said chair pad when said back section is in said upright position;

a plurality of chair wheels, each of said chair wheels being coupled to said chair frame wherein said wheels facilitate transport of a person seated on said chair pad;

said chair frame comprising a pair of arm rests, each said arm rest being adjustable between an extended position and a retracted position, each said arm rest being positioned in alignment with said back section in said retracted position wherein each said arm rest is prevented from interfering with positioning of said chair pad occupying said slot, each said arm rest being pivotally coupled to said back section extend forwardly from said back section and above an upper surface of said chair pad when said arm rest is in said extended position; and a foot rest assembly pivotably coupled to said chair frame, said foot rest assembly being pivotable between a use position and a storage position, said foot rest assembly extending outwardly relative to a perimeter edge of said chair pad when in said use position, said foot rest assembly including a pair of foot supports, each of said foot supports being spaced below said chair pad wherein said foot supports are configured for supporting feet of a person seated on said chair pad, said foot rest assembly comprising a pair of rest wheels, said rest wheels extending lower than said foot supports such that said rest wheels are configured to support said foot supports over a ground surface when said foot rest assembly is in said use position.

* * * * *